United States Patent [19]

Schlatter et al.

[11] 4,360,152

[45] Nov. 23, 1982

[54] AUXILIARY HEATING SYSTEM

[76] Inventors: Lester E. Schlatter; Steven J. Miller, both of R.R. 1, Wayland, Iowa 52654

[21] Appl. No.: 184,920

[22] Filed: Sep. 8, 1980

[51] Int. Cl.[3] ..... F24D 1/00

[52] U.S. Cl. ..... 237/13; 110/234; 122/15; 237/8 R; 237/19

[58] Field of Search ..... 237/13, 16, 19, 8 R; 126/132, 133; 110/234; 122/13 R, 15

[56] References Cited

U.S. PATENT DOCUMENTS

| | | | |
|---|---|---|---|
| 2,704,188 | 3/1955 | Bergmann | 237/8 R |
| 3,958,755 | 5/1976 | Cleer, Jr. | 237/8 R |
| 4,046,320 | 9/1977 | Johnson et al. | 237/8 C |
| 4,050,441 | 9/1977 | Horwinski | 126/121 |
| 4,050,626 | 9/1977 | Awalt, Jr. | 126/132 |
| 4,124,178 | 11/1978 | Burke | 237/19 |
| 4,131,231 | 12/1978 | Cleer, Jr. | 237/8 R |
| 4,143,638 | 3/1979 | Kamstra et al. | 126/121 |
| 4,143,816 | 3/1979 | Shadeland | 126/132 |
| 4,149,517 | 4/1979 | Horwinski | 126/121 |
| 4,153,199 | 5/1979 | Ellmer | 126/132 |
| 4,179,065 | 12/1979 | Zung | 237/51 |

*Primary Examiner*—Ronald C. Capossela

*Attorney, Agent, or Firm*—Zarley, McKee, Thomte, Voorhees & Sease

[57] ABSTRACT

An auxiliary boiler is provided for substantially reducing fuel consumption of a conventional forced-air heating system. A boiler tank substantially filled with water is connected by hot and cold water lines to a heat exchanger disposed within the cold air duct of the forced-air heating system. A firebox which extends into the boiler tank is adapted to receive combustible material such as wood for heating the water in the tank. A pump directs hot water from the tank through the hot water line to the heat exchanger whereby cool air moving through the cold air duct is preheated as it passes through the heat exchanger. Heating tubes in communication with water in the boiler tank may extend through the firebox for supporting logs therein. Additional heating tubes may extend through a flue directed upwardly from the firebox through the boiler tank.

4 Claims, 4 Drawing Figures

AUXILIARY HEATING SYSTEM

BACKGROUND OF THE INVENTION

The present invention is directed generally to an improvement for reducing the fuel consumption of conventional forced-air heating systems and more particularly to an auxiliary firebox-heated boiler including a heat exchanger in the cold air return of a forced-air heating system for pre-heating the air being fed through the conventional furnace.

In conventional forced-air systems, the furnace unit requires expensive natural gas or electricity for heating air which is forced by blowers through hot air ducts to a space to be heated. At the same time, cool air is drawn into the furnace through cold air ducts which are also in communication with the space to be heated. Boilers have previously been provided in communication with heat exchangers in the cold air duct for pre-heating air introduced to the main furnace but little if any advantage is gained by such a boiler which itself requires gas or electricity for heating the water therein.

Accordingly, it is a primary object of the present invention to provide in combination with a conventional forced-air heating system, an auxiliary boiler/-heat exchanger combination wherein the boiler is adapted to be fueled with relatively inexpensive combustible materials such as wood, coal and the like.

Another object is to provide in such combination, an improved boiler having a firebox extended into and substantially surrounded by the tank portion thereof.

Another object is to provide such a boiler including a flue directed upwardly from the firebox through the tank thereby providing additional surface area for heating fluid in the boiler tank.

Another object is to provide such a boiler wherein heating tubes in communication with fluid in the boiler tank extend through the firebox at a position for supporting combustible material.

Another object is to provide a forced-air heating system equipped with an auxiliary firebox-heated boiler, which system is adapted to first rely on the boiler to supply heat and secondarily rely on the conventional furnace only when the heating requirements exceed boiler capability.

These and other objects of the invention will be apparent to those skilled in the art from the following summary and description.

SUMMARY OF THE INVENTION

The present invention provides a modification to conventional forced-air heating systems which enables the modified system to consume relatively inexpensive fuel such as wood, coal or the like instead of the more expensive energy source for the main furnace, which may be natural gas or electricity. This is accomplished by providing an auxiliary boiler tank in communication with a heat exchanger in the cold air return of the forced-air heating system. A firebox which extends into the boiler tank is adapted to receive combustible material such as wood for heating water in the tank. The water is then pumped through the heat exchanger for pre-heating cool air being drawn into the main furnace through the cold air return. The firebox is substantially surrounded by fluid in the boiler tank for heating the fluid. Additional heating surfaces may be provided by extending a flue from the firebox upwardly through the boiler tank and providing inclined heating tubes extending through the firebox and flue.

The auxiliary heating system of the present invention contemplates providing an auxiliary thermostat in the space to be heated so that the pump for the boiler fluid will be activated at a temperature above the setting for the main furnace so that the main furnace will be activated only when the heating requirements exceed the capabilities of the auxiliary boiler and heat exchanger.

DESCRIPTION OF THE PREFERRED EMBODIMENT

Figure 1:
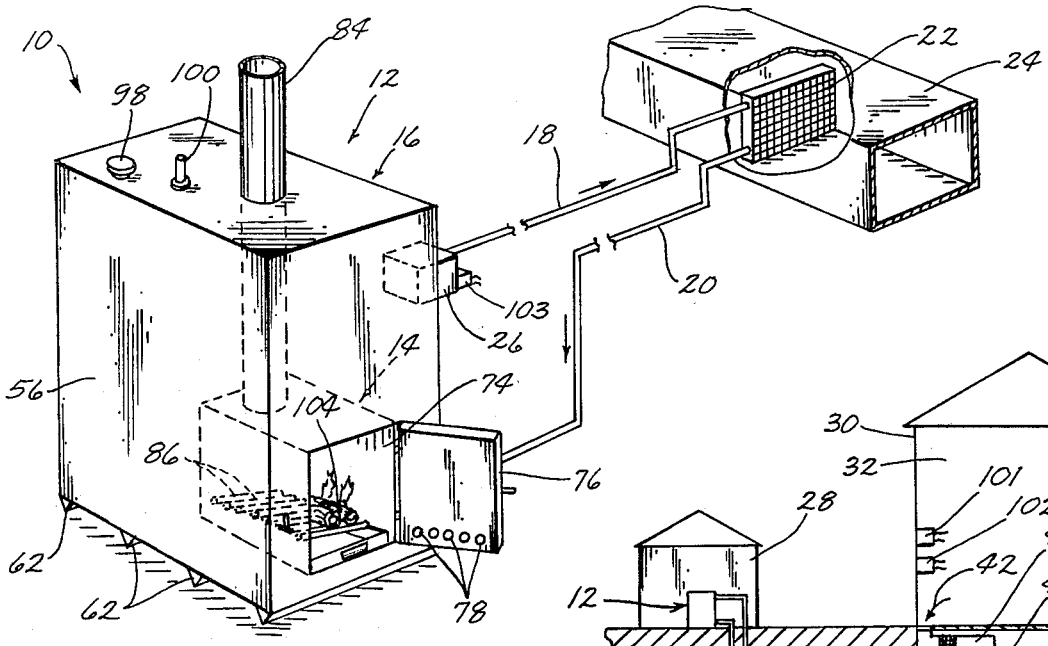
FIG. 1 is a partially fragmented perspective view of the auxiliary heating system of the invention.

Auxiliary heating system (10) of the present invention includes an auxiliary boiler (12) having a firebox (14) extending into a boiler tank (16) for heating fluid in the tank. A pair of hot and cold fluid conduits (18) and (20) communicate at one end with the boiler tank (16) and communicate at the other end with a heat exchanger (22) situated within the cold air return (24) of a conventional forced-air heating system. A pump (26) is operatively associated with the hot fluid conduit (18) for pumping fluid from the tank through the conduit (18) and to the heat exchanger for pre-heating the air as it is drawn through the heat exchanger for introduction into the main furnace.

Figure 2:
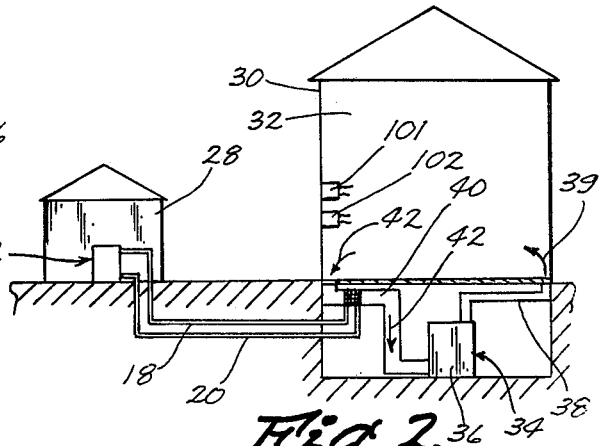
FIG. 2 is a diagramatic partially sectional elevational view of the auxiliary heating system.

FIG. 2 diagramatically illustrates an embodiment wherein the auxiliary boiler (12) is housed in a building (28) remotely situated from a main building (30) which includes an interior space (32) to be heated and a conventional forced-air heating system indicated generally at (34). Heating system (34) includes a main furnace (36) having a hot air duct (38) for conveying heated air to the space (32) as indicated by arrow (39) and a cold air duct (40) for returning cool air from space (32) to the main furnace blower as indicated by arrows (42). The hot and cold fluid conduits (18) and (20), which provide fluid communication between the heat exchanger (22) and boiler tank (16) are extended below grade at a depth below the freeze line between main building (30) and remote building (28).

Figure 3:
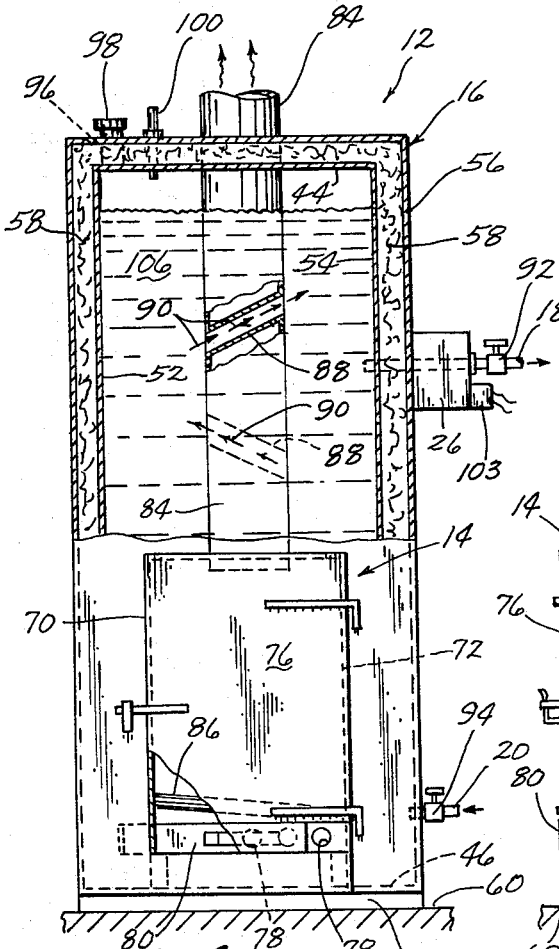
FIG. 3 is an enlarged, partially sectional front view of the firebox-heated boiler of the invention; and, FIG. 4 is an enlarged, partially sectional side view of the firebox-heating boiler.
Figure 4:
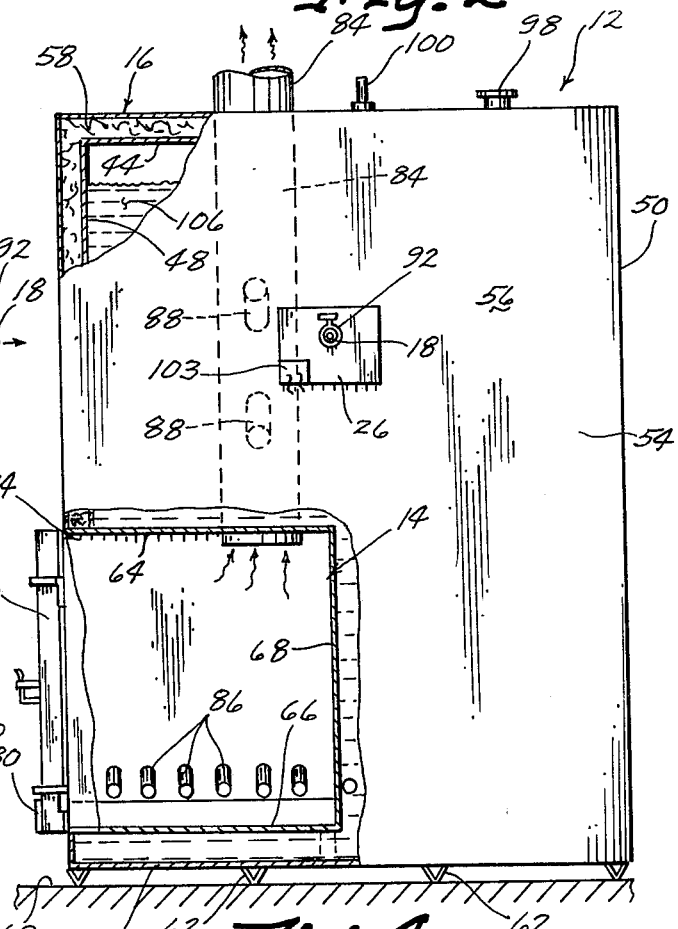

FIGS. 3 and 4 show that the boiler tank (16) of auxiliary boiler (12) includes a top wall (44); a bottom wall (46); front and rear wall portions (48) and (50), respectively; and opposite side wall portions (52) and (54), respectively. An outer housing (56) may be disposed about the outer periphery of boiler tank (16) with insulation material (58) interposed therebetween for preventing heat from being dissipated to the space surrounding the boiler tank (16). The boiler tank is supported above floor surface (60) by a plurality of transversely extended support members (62).

Firebox (14) exends into boiler tank (16) and includes a top wall (64), a bottom wall (66), a rear wall (68) and opposite opposite side walls (70) and (72) respectively. The firebox has an open front end (74) which opens through the front wall portion (48) of the boiler tank. The various firebox walls are sealed to one another and to the boiler tank front wall to prevent fluid from entering the firebox or draining from the boiler tank. A hinged door (76) is provided for closing the open front end (74) of the firebox. The door includes a plurality of air intake openings (78) which are adjustably closeable by a slide plate (80) for regulating the air supply to the firebox.

It is seen in FIG. 3 that the firebox side walls (70) and (72) are spaced from boiler tank side wall portions (52) and (54). Likewise, in FIG. 4 it is seen that firebox rear wall (68) is space from rear wall portion (50) and that the firebox bottom wall (66) is supported above the boiler tank bottom wall (46) with the result that the firebox is surrounded by fluid on all sides except at the open front end (74). The forward end of the firebox is supported on front wall portion (48) and the rearward end of the firebox is supported on legs (82).

A flue (84) extends upwardly through the firebox and boiler tank (16) for venting the products of combustion within the firebox. The flue is also sealed relative to the firebox and boiler tank to prevent the drainage of fluid from the tank. Since the flue (84) is also substantially surrounded by fluid in the tank (16), it presents additional surface area for heating fluid in the boiler tank (16).

A plurality of open-ended heating tubes (86) extend transversely through a lower portion of the firebox (14). The heating tubes perform two functions. First, they serve as a grate for supporting logs within the firebox as indicated in FIG. 1. Secondly, they provide still further surface area for heating fluid in the tank. For this purpose, the heating tubes are inclined relative to a horizontal plane to induce convection flow through the tubes for increased heat transfer.

Additional heating tubes (88) are transversely extended through the flue (84), with tubes (88) also being inclined relative to a horizontal plane to induce convection flow therethrough as indicated by arrows (90).

Various additional plumbing hardware on the boiler tank (16) includes shut-off valves (92) and (94) on the hot and cold fluid conduits (18) and (20), respectively, a fluid-filler opening (96) and cap (98) and a pressure-relief valve (100).

Referring to FIG. 2, there is shown a first thermostat (101) which is positioned within the space (32) to be heated and which is electrically connected to the main furnace (36) for energizing the heat source therein when the temperature in space (32) falls below a selected first temperature setting. A second thermostat (102) is also positioned within space (32) and electrically connected to pump (26) for energizing the pump when the temperature in space (32) falls below a second selected temperature setting. The auxiliary heating system of the invention contemplates adjusting the setting of second thermostat (102) to a higher temperature than the setting of first thermostat (101) for a purpose described below.

A third thermostat (103) is operative to sense the fluid temperature within tank (16) and to disable the pump (26) when the fluid temperature falls below a third selected temperature setting.

In operation, the typical settings for the thermostats may be sixty-eight degrees for the first thermostat (101), seventy degrees for the second thermostat (102) and third thermostat. To activate the auxiliary heating system (101), combustible material such as wood logs (104) are inserted into the firebox on grate (86) and ignited. Door (76) is closed and slide plate (80) is adjusted to regulate the desired air flow to the firebox. As combustion gases are exhausted through flue (84), the firebox, flue and heating tubes (88) and (86) become hot and thereby heat the fluid within boiler tank (16). When the room temperature within space (32) falls below seventy degrees, second thermostat (102) activates pump (26) to pump hot fluid through conduit (18) and heat exchanger (22) for heating the air passing through the cold return (24). For this purpose, it is preferred that the blower of the main furnace (36) be manually set for continuous operation so as to maintain a continuous draught through the cold air return (24). If the fluid in boiler tank (16) is sufficiently hot, the heat exchanger (22) alone may be effective for maintaining the temperature in space (32) above sixty-eight degrees so that the main furnace is not activated with the result that no natural gas or electricity is consumed. Even if the heating requirements are such that they cannot be completely satisfied by the heat exchanger (22), the pre-heating of cold air within the cold air return (24) substantially reduces the heating load on the main furnace (36) so as to result in substantially reduced fuel consumption by the main furnace.

In the event that the fire in the firebox (14) becomes extinguished and the fluid (106) cools to a temperature below seventy degrees, pump (26) is disabled by third thermostat (103) with the result that the temperature within space (32) may be heated in the conventional manner by main furnace (36) in association with first thermostat (101).

Whereas a preferred embodiment has been disclosed herein, it is apparent that many alterations, modifications and substitutions may be made within the intended broad scope of the appended claims. The fluid (106) within boiler tank (16) may be water, an anti-freeze solution or any other effective heat exchanger fluid. Whereas the grate formed by heating tubes (86) is adapted for supporting logs, an additional support surface could be provided for supporting coal, or other known combustible materials.

Thus there has been shown and described an auxiliary heating system which accomplishes at least all of the stated objects.

We claim:

1. In combination with a forced-air heating system including a furnace having a heat source therein, a hot air duct connected to said furnace for conveying hot air to a space to be heated, and a cold air duct connected to said furnace for returning cool air from said space to said furnace, the invention comprising an auxiliary boiler adapted to be stoked with combustible material, comprising, a boiler tank adapted to be substantially filled with a heat exchanger fluid, a firebox extended into said tank and adapted to receive combustible material for heating the fluid in said tank, a heat exchanger disposed within said cold air duct, a hot water supply conduit connected at one end to said tank and connected at its opposite end to said heat exchanger for supplying warm fluid thereto, a cold fluid return conduit having opposite ends connected to said heat exchanger and tank respectively, and pump means for pumping hot fluid from said tank through said supply conduit to said heat exchanger whereby cool air moving through said cold air duct is pre-heated as it passes through said heat exchanger, a plurality of heating tubes extended through said firebox and in communication with said tank at the opposite ends thereof for heating fluid in said tubes, the opposite ends of said heating tubes being disposed in vertically spaced-apart relation whereby fluid heated in said tubes is passed therethrough by convection flow, said heating tubes being disposed in a lower portion of said firebox for supporting said combustible material thereon, a flue extending upwardly from said firebox through said tank, a plurality of heating tubes extending through said flue and in communication with said tank at the opposite ends thereof for heating fluid in said tubes, said boiler tank including a top wall, bottom wall, front and rear wall portions, and opposite side wall portions, said firebox including an open end which opens through said front wall portion, and further comprising a movable door adapted to at least partially close said open end at times, means for supporting said firebox in spaced relation from said bottom wall, top wall, side wall portions, and rear wall portion whereby said firebox is substantially surrounded by fluid except at the open end thereof, a first thermostat operatively positioned in said space to be heated and electrically connected to said furnace for activating said heat source of the furnace when the temperature in said space falls below a first selected temperature, and a second thermostat operatively positioned in said space and electrically connected to said pump means for activating said pump means when the temperature in said space falls below a second selected temperature higher than said first selected temperature whereby said heat source of the furnace will remain inactive for so long as the temperature in said space is maintained above said first selected temperature by said heat exchanger.

2. The combination of claim 1 further comprising a third thermostat in communication with the fluid in said tank and electrically connected to said pump means for deactivating said pump means when the temperature of said fluid falls below a third predetermined temperature.

3. The combination of claim 1 further comprising first and second remotely situated buildings, said forced-air heating system being situated in said first building and said wood-fired boiler being situated in said second building and said hot and cold fluid conduits extending below grade between first and second buildings.

4. The combination of claim 1 wherein said combustible material is wood.

* * * * *